US008510885B2

(12) United States Patent
Dennis et al.

(10) Patent No.: US 8,510,885 B2
(45) Date of Patent: Aug. 20, 2013

(54) ANATOMICAL, PRESSURE-EVENIZING MATTRESS OVERLAY AND ASSOCIATED METHODOLOGY

(76) Inventors: Casey A. Dennis, Sequim, WA (US); Michael R. Dennis, St. Helens, OR (US)

( * ) Notice: Subject to any disclaimer, the term of this patent is extended or adjusted under 35 U.S.C. 154(b) by 260 days.

(21) Appl. No.: 12/798,390

(22) Filed: Apr. 2, 2010

(65) Prior Publication Data

US 2010/0192306 A1 Aug. 5, 2010

Related U.S. Application Data

(63) Continuation-in-part of application No. 12/657,568, filed on Jan. 21, 2010, now abandoned.

(60) Provisional application No. 61/206,126, filed on Jan. 28, 2009.

(51) Int. Cl.
*A47C 17/00* (2006.01)

(52) U.S. Cl.
USPC ..... 5/699; 5/691; 5/740; 5/739

(58) Field of Classification Search
USPC ..... 5/699, 740, 484, 691, 739
See application file for complete search history.

(56) References Cited

U.S. PATENT DOCUMENTS

| | | | |
|---|---|---|---|
| 3,507,727 | A | 4/1970 | Marshack |
| 3,872,525 | A | 3/1975 | Lea et al. |
| 4,245,364 | A | 1/1981 | Calleance |
| 4,292,703 | A | 10/1981 | Goguen |
| 4,326,310 | A | 4/1982 | Frankenberg |
| 4,901,387 | A | 2/1990 | Luke |
| 5,031,261 | A | 7/1991 | Fenner, Sr. |
| 5,060,642 | A | 10/1991 | Gilman |
| 5,077,849 | A | 1/1992 | Farley |
| 5,282,286 | A | 2/1994 | MacLeish |
| 5,310,400 | A | 5/1994 | Rogers et al. |
| 5,542,137 | A | 8/1996 | Byfield |
| 5,974,608 | A | 11/1999 | Haller et al. |
| 6,052,851 | A | 4/2000 | Kohnle |
| 6,656,856 | B1 | 12/2003 | Rucker |
| 6,812,375 | B2 | 11/2004 | Dennis et al. |
| 6,852,102 | B1 | 2/2005 | Vernoy |
| 6,859,948 | B2 | 3/2005 | Melts |

(Continued)

OTHER PUBLICATIONS

ISR dated Feb. 7, 2011 in PCT Patent Application Serial No. PCT/US2010/059006. 15 pp.

(Continued)

*Primary Examiner* — Robert G Santos
*Assistant Examiner* — Brittany Wilson
(74) *Attorney, Agent, or Firm* — Mohr Intellectual Property Law Solutions, PC

(57) ABSTRACT

A method and structure for furnishing pressure-evenized, dynamic-reaction anatomical support. The method includes (a) supporting the anatomy with a 100% open cell viscoelastic foam, and (b) within the foam, reacting to both static and dynamic, anatomically-produced foam indentations to expand and contract cell-openness size, whereby deeper/sharper indentations result in greater-size cell-openness. Such reacting includes laterally stretching and flowing regions of the foam adjacent such an indentation The overlay structure features (1) a dynamic-response core expanse formed of a 100% open-cell, compressible and flowable, polyurethane, viscoelastic foam possessing a compressed, relaxed-state volume, and (2) an elastomeric, moisture- and gas-flow-managing coating, load-transmissively, bonded to the entirety of the core expanse's outside surface to function as a dynamically-responsive unit with the expanse. The coating possesses a relaxed-state, prestressed tension condition which is responsible for the expanse's compressed condition.

20 Claims, 2 Drawing Sheets

(56) References Cited

U.S. PATENT DOCUMENTS

| | | | |
|---|---|---|---|
| 6,948,207 | B2 | 9/2005 | Daly |
| 7,356,863 | B2 | 4/2008 | Oprandi |
| 2001/0034908 | A1 | 11/2001 | Daly |
| 2002/0148045 | A1 | 10/2002 | Giori et al. |
| 2002/0148047 | A1 | 10/2002 | Corzani et al. |
| 2004/0209062 | A1 | 10/2004 | Sebag |
| 2004/0250348 | A1 | 12/2004 | Grimes |
| 2005/0017396 | A1 | 1/2005 | Pearce et al. |
| 2005/0278852 | A1 | 12/2005 | Wahrmund et al. |
| 2006/0031996 | A1 | 2/2006 | Rawls-Meehan |
| 2007/0022540 | A1 | 2/2007 | Hochschild |
| 2007/0265586 | A1 | 11/2007 | Joshi et al. |
| 2008/0119774 | A1 | 5/2008 | Paasche |
| 2009/0044338 | A1 | 2/2009 | Rock et al. |
| 2009/0188048 | A1 | 7/2009 | Shlomo |
| 2010/0192306 | A1 | 8/2010 | Dennis et al. |

OTHER PUBLICATIONS

USPTO Office Action dated Feb. 2, 2011 in U.S. Appl. No. 12/657,568. 11 pp.

USPTO Office Action dated Jun. 12, 2009 in U.S. Appl. No. 11/983,259. 11 pp.

USPTO Office Action dated Apr. 22, 2010 in U.S. Appl. No. 11/983,259. 7 pp.

USPTO Office Action dated Dec. 8, 2010 in U.S. Appl. No. 11/983,259. 10 pp.

USPTO Office Action dated Apr. 26, 2011 in U.S. Appl. No. 11/983,259. 8 pp.

ANATOMICAL, PRESSURE-EVENIZING MATTRESS OVERLAY AND ASSOCIATED METHODOLOGY

CROSS REFERENCE TO RELATED APPLICATION

This application is a continuation-in-part of U.S. patent application Ser. No. 12/657,568, filed Jan. 21, 2010, now abandoned for "Anatomical, Pressure-Evenizing Mattress Overlay", which claims filing-date priority to prior-filed U.S. Provisional Patent Application Ser. No. 61/206,126, filed Jan. 28, 2009, for "Anti-Decubitus-Injury Mattress Overlay". The entire disclosure contents of these two, prior-filed applications are hereby incorporated herein by reference.

BACKGROUND AND SUMMARY OF THE INVENTION

The present invention pertains to a special-purpose, special-capability, breathable, friction- and shear-controlling, anatomical-support, pressure-evenizing, "mattress overlay" intended to be placed on top of, and used in conjunction with, an underlying, yieldable support surface, such as that provided by a mattress, for the purpose of furnishing "direct", pressure-evenizing under-support for a substantially bed-ridden person. In particular, the invention relates to an improved version of the invention described in the above-referenced '568, immediate-parent patent application.

The invention, described herein principally, at least initially, in the realm of structure, also concerns methodology which is associated with this overlay.

The overlay of the invention is specifically designed, as will be explained more fully below, with thinness suitable, with appropriate, yieldable under-support, for handling persons weighing up to about 350-lbs. It is definitively not designed to be used alone as a support on top of any rigid, underlying surface; nor is it intended to be a "stand-alone" support structure, such as a mattress, per se. Where heavier persons need to be accommodated, this may be done, as will also be explained more fully below, by placing the overlay on top of an additional, bariatric, under-support structure.

Accordingly, the herein-proposed overlay, in its preferred and best-mode form, has a thickness which is preferably no more than about 1-inches. This preferred thickness militates against its utilization respecting the "not-designed-for" uses just above mentioned.

The term "bed-ridden" as used herein as a "person characterization" is intended broadly to include a wide range of differently convalescing persons who may spend significant amounts of extended, body-support time not only specifically in hospital beds, but also on and in conjunction with other bed-like mattress structures.

Speaking with more particularity about the invention, and about what we see to be its remarkable, and experimentally demonstrated capability, it, the proposed "mattress overlay", has as its special purpose the dramatic minimization, and in many instances the complete prevention, of the onset and development of decubitus ulcers(sores)—medical conditions that lead to dangerous and potentially lethal injuries which come from long-term body-rest/support conditions. Accordingly, the overlay of the present invention is naturally, and particularly, well suited for placement on top of conventional, long-term, person/patient-support mattresses, such as hospital-bed mattresses. While such a hospital-bed setting clearly presents an ideal use environment for the present invention, the defining term "mattress overlay" is intended herein to refer to any overlay structure constructed in accordance with the special and unique features of the present invention which may be shaped, sized, etc., for use not only on top of an underlying, conventional mattress structure, per se, but also in other similar environments where nonambulatory people, such as convalescing patients, may lie recurrently supported for long periods of time. The above-expressed concept of "direct", underlying, person support, while it could (and can) include the concept of direct-to-skin contact support, herein more typically means support which is furnished, for example, (a) "directly through" clothing (such pajamas, a hospital gown, etc.), (b) through a bed sheet, or (c) through some combination of these and like things.

Regarding the above-mentioned special purpose of the present invention, it is now, and has been for some time, well recognized that the medical issue involving the development of decubitus ulcers in bed-ridden, etc., patients, often those people who are still in the environment of a hospital recovering from some medical event or condition, is an extremely serious problem—a problem which has recently caught the significant negative attention of medical-institutional (and related) insurance agencies who have come to recognize that prevention of the development of such ulcers is, in fact, quite possible, though through conventional approaches very challenging. This "negative attention" has translated itself, among other things, into agency refusals to offer/provide relevant insurance coverage. While the just-mentioned term "quite possible" is indeed true, real prevention—that is, effective real prevention—heretofore has been almost prohibitively expensive because of the fact that such prevention has, in reality, required substantial, frequent, personnel-intensive, one-to-one, or more-to-one, personal attendance to the changing of the resting "positions" of "bed-ridden" persons at risk.

The decubitus ulcer (decubitus-onset, decubitus-injury, decubitus-injury onset) problem is recognized today as being one of the most serious problems facing hospital and medical-care facilities, and these skilled care facilities are openly waging a fierce battle with state and federal agencies and insurance companies over who should pay the enormous costs in the treatment of this "new epidemic."

In this setting, the prior art, of which we are aware, that has been aimed at addressing the "decubitus-injury" problem is rich with purportedly effective, proposed approaches for resolving it. In practice, none appears to be particularly successful or satisfactory, owing, as we perceive it, to the significant and apparent failure to grasp a comprehensive understanding of the key body-support environmental and contact conditions which must exist if decubitus "onset" is to be avoided. The present invention, we believe, "possesses" this understanding, for, in months of experimental use, involving thousands of patient-support days, and hundreds of bed-ridden patients, there have been almost no instances of decubitus-injury onset.

Presently known (to us), patent-related pieces of this prior art include: U.S. Patent Application Publication No. 2001/0034908 A1 of Duly, for "Mattress"; U.S. Pat. No. 5,031,261 to Fenner, Sr., for "Mattress Overlay For Avoidance of Decubitus Ulcers"; U.S. Pat. No. 5,077,849 to Farley, for "Anatomically Conformable Foam Support Pad"; U.S. Pat. No. 6,052,851 to Kohnle, for "Mattress For Minimizing Decubitus Ulcers"; U.S. Pat. No. 7,356,863 to Oprandi, for "Mattress Pad".

While these identified, prior-art approaches address, and attempt to tackle with resolution, certain technical medical issues and conditions that can lead to the development of a decubitus injury (frequently referred to as a decubitus ulcer), clearly taking aim at successfully minimizing costly medical-personnel attention to "decubitus-at-risk" individuals, as far as we can tell, no one has successfully developed a truly effective support structure and/or methodology which has (have) the capabilities of substantially eliminating, in most instances, the likelihood that such a decubitus ulcer will develop.

The present invention dramatically changes this situation. While readings and study of this prior art, when compared with a reading of the present invention disclosure, may appear at first glance, and on certain points, to reveal only subtle differences, in reality these differences, in terms of solving the problem of decubitus onset, are anything but subtle. Put another way, these differences "make the difference"!

While there are probably many issues that are usefully addressable in terms of preventing decubitus ulcers, the three, key considerations which we specially recognize in the methodology and structure of the present invention involve:

(a) (1) avoiding even very short-term (minutes) of high, applied anatomical pressure, (2) at all times pressure-evenizing the contact-loading characteristics which define how the anatomy of a bed-ridden patient is supported, and (3) specifically producing an anatomical loading condition, static and dynamic, whereby there exist substantially no notably high-pressure points (preferably none exceeding about 32-mm Hg, and even more preferably not exceeding about 20-mm Hg), and definitively no conditions involving a projecting portion of the person's anatomy (i.e., a protuberance) bottoming out against either a non-yielding, or relatively non-yielding, underlying support surface, or in any manner significantly raising (de-evenizing) anatomical support pressure;

(b) minimizing friction and shear engagement between the proposed overlay structure and a supported patient; and (c), very importantly, providing effective, ventilating, heat-removing airflow (more broadly, gas flow) in the region immediately beneath the contact-supported anatomy so as to avoid the development of hot-spots and overheating, and especially recognizing that those portion of a supported anatomy, such as bony prominences, which create notable, downward "indentations" in an underlying support structure should be offered proportionally larger access to air (gas) flow.

Stressing this just-identified, third, heat-removal, airflow-associated concern, and repeating, with emphasis, the "proportionally" greater airflow comment just made above, it is especially relevant that the points/areas/regions of underlying anatomical support which must deal with the mentioned, notable, anatomical protuberances, and especially with pronounced (i.e., relatively "sharp") protuberances, be designed to furnish locally enhanced, rather than more constricted, airflow within the anatomical support structure. Put another way such protuberance-support areas are the ones that potentially define the greatest risk for decubitus-ulcer development, and as we have discovered, are the areas where the most robust, ventilating airflow and air-circulation capability need to exist. Generally speaking, the greater the size and/or "sharpness" of the protuberance, and thus the greater and the deeper and the more angular the resulting support-surface indentation, the greater the need for enhanced, support-structure airflow and air-circulation capability.

Unfortunately, known and proposed prior art manners of attacking the decubitus-ulcer problem do not recognize this special, anatomical-protuberance-support observation of ours, and failing that observation, actually propose supposedly problem-resolving body-support structures and associated methodologies which exacerbate the airflow problem associated with protuberance support by reacting to downward protuberances with either no attention paid to airflow, or even worse, increased constriction to airflow.

With this background in mind, the present invention, in its structural character, takes the form of an anatomical pressure-evenizing mattress overlay including (a) a dynamic-response, preferably uniform-thickness core expanse having spaced, upper and lower, surfaces and a perimetral edge extending between these surfaces, formed of a 100% open-cell, uniform-density compressible and flowable, viscoelastic foam, and having a "relaxed-state" volume in the overlay which is prestressed, by being about 8-10% compressed, to create a pre-stressed, pre-compression condition in the expanse, and (b) a differential-thickness, elastomeric, vinyl coating having, due to differential thickness, specifically different moisture-handling and gas-breathability characteristics furnished importantly at different, selected locations in the overlay (as will shortly be explained). This coating, which is referred to herein as an at least partially gas-breathable coating (quite freely breathable on the edges of the overlay), is load-transmissively, interfacially bonded to the entirety of the outside surface area of the core expanse to function as a dynamically-responsive unit with the expanse—this coating possessing a "relaxed-state", internal, prestressed tension condition which is responsible for the pre-stressed, pre-compression condition in the core expanse. The term "relaxed-state" herein is used to refer to the conditions of the components (two) making up the pad when the pad is in a non-use situation.

The core expanse is specifically and preferably formed of a specific-character, solid-phase, single-component, single-density, polyurethane material, shaped with its upper and lower surfaces substantially equidistant (i.e., the core expanse has preferably a uniform thickness) to give the overlay, as a whole, a substantially uniform thickness of no more than about 1-inches, with the differential-thickness coating having a thickness of about 0.01-inches on and along the elongate, "vertically central" regions of the overlay edges, and about 0.02-inches elsewhere—dimensional matters of choice, but specifically found to be very useful, and consequently "preferred".

Accordingly, and for important structural and performance reasons which will be explained later herein regarding the coating, immediately outwardly (from the core expanse) beyond an initially created, overall primer sublayer (which flows into the core expanse material—an open cell foam material), the coating, distributed in an all-over configuration relative to the core expanse, is formed therefore on both the overlays perimetral edges and on its broad-surface areas, and specifically is preferably formed with ten, approximately 0.001-inches thick, cured, sublayers. These ten sublayers, further, are preferably spray-applied, one over another, under "wet-form", interlayer bonding circumstances, where the "previously applied", next-spray-receiving sublayer, including the mentioned primer sublayer (which adds substantially no depth to the coating, per se), is still wet and not yet cured.

Different-thickness (greater-thickness) coating portions cover the two broad-surface areas in the overlay, as well as two, vertically spaced, upper and lower bands of the overlay's perimetral edge regions. These thicker coating portions include outer, eleventh, individually thicker (about 0.01-inches) sublayers which are sprayed onto the immediately underlying, ten, thinner, "all-over, basic" sublayers after those underlying basic sublayers have dried. These thicker coating portions form moisture-shielding (impervious), core-protection "caps" covering the opposite faces and nearby, perimetral, lateral-edge regions of the core expanse, and define, in the space between them, the previously mentioned, elongate, vertically central regions of the overlay's laterally outwardly facing perimeter to define effective, and important, lateral breathability for the overlay's core expanse.

The just-mentioned, wet-interlayer sublayer joinder methodology (and arrangement) employed in relation to the preferred, ten, basic sublayers in the coating produces, structurally, a final, cured, layered coating having, between substantially all next-adjacent, basic sublayers, and between the innermost, basic sublayer and the primer sublayer, what we refer to structurally herein as being finally cured, but initially wet, interfacial surfaces of joinder. We have found that this special type of wet, interfacial joinder structure enhances not only the gas-breathability characteristics of the overall coating, but also, importantly, the controlled shrinkage of the coating to produce the desired level of coating-internal tension, and core-expanse-internal compression. The one "area", however, and as was just pointed out, of the prepared coating wherein the wet-interfacial joinder approach is not employed involves the application to each of the broad facial areas in the overlay of the final, eleventh coating sublayer.

Regarding the selectively differential gas-breathability aspects of the proposed coating (i.e., what may be thought of as being the coating "permeability-differentiating" features), the two (upper- and lower-face) broad-area regions of the coating in the overlay, and the two, vertically spaced, perimetral "bands" of extra-thickness coating sublayers which join with these broad-area regions, are structured with their respective, eleventh, outermost, 0.01-inch-thickness sublayers formed so as to be substantially both moisture-impervious and gas-impermeable in nature, whereas the associated, ten, next-inner, "basic" sublayers are structured to be both moisture-resistant (but moisture-pervious) and gas-permeable.

One practical and successful way of creating the coating to possess the mentioned sublayers with the respective, desired thicknesses and differential-permeability characteristics is set forth later herein.

The detailed description of the invention which follows below will describe fully the features of, and the importances attached to, the matters of core-expanse-material flowability, coating tension, core-expanse compression, coating-core-expanse mechanical binding to one another, and coating "permeability-differentiating" features.

The overlay, per se, which is elongate and generally planar in nature, has no preferential upper or lower end, and no preferential top or bottom face, or side. It can, accordingly, confidently be placed with any suitable orientation on an appropriate supporting under-structure.

From a methodologic general perspective, the invention involves a method for furnishing pressure-evenized, dynamic-reaction support for the anatomy including (a) supporting the anatomy with a 100% open cell, polyurethane, viscoelastic foam, and following such supporting, and within the supporting foam, reacting therein to both static and dynamic, anatomical-unevenness-produced indentations in the foam to expand and contract foam cell-openness size, whereby deeper and sharper foam indentations result in greater cell-openness size.

These and other features and advantages offered by the present invention will become more fully apparent as the detailed description which now follows is read in conjunction with the accompanying drawings.

DESCRIPTIONS OF THE DRAWINGS

Figure 2:
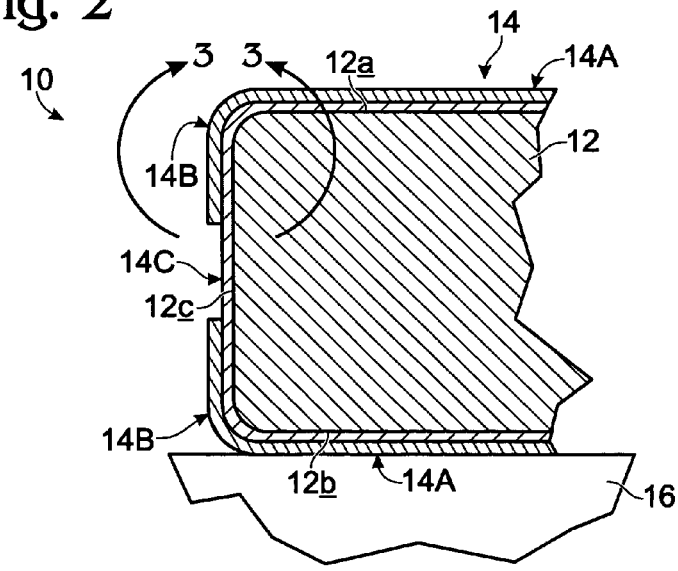
FIG. 2 is a larger scale, fragmentary, cross-sectional view taken generally along the line 2-2 in FIG. 1.
Figure 3:
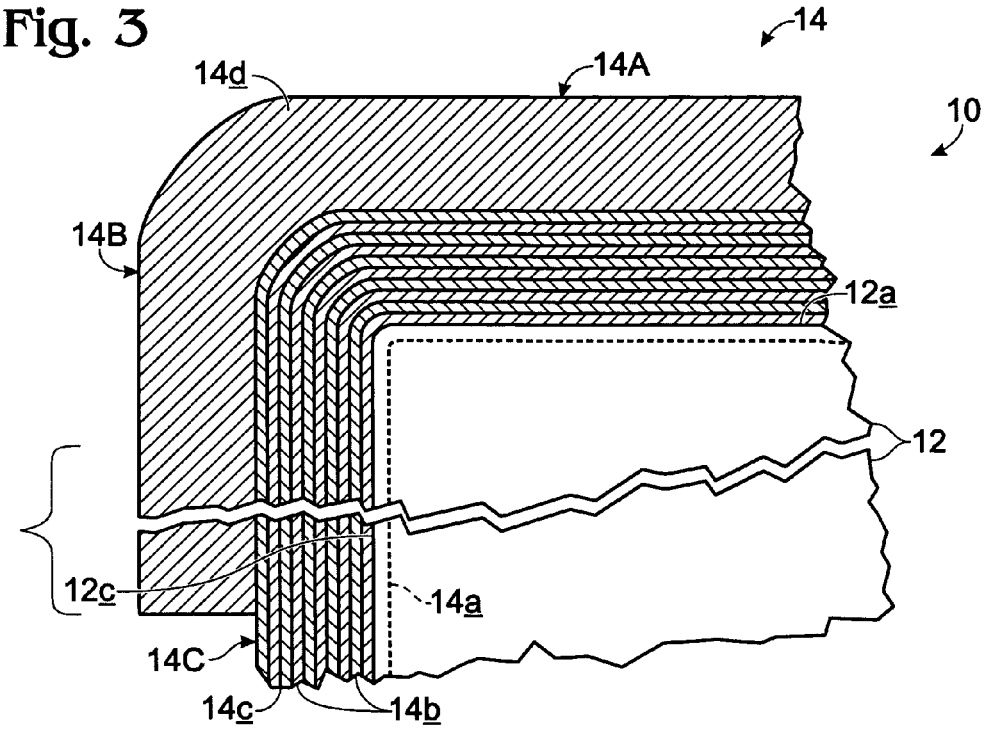
FIG. 3 is an even larger-scale, fragmentary illustration of the region generally embraced by the two, curved arrows 3-3 in FIG. 2.

In FIGS. 2 and 3, the various overlay components are not drawn to scale.

Figure 1:
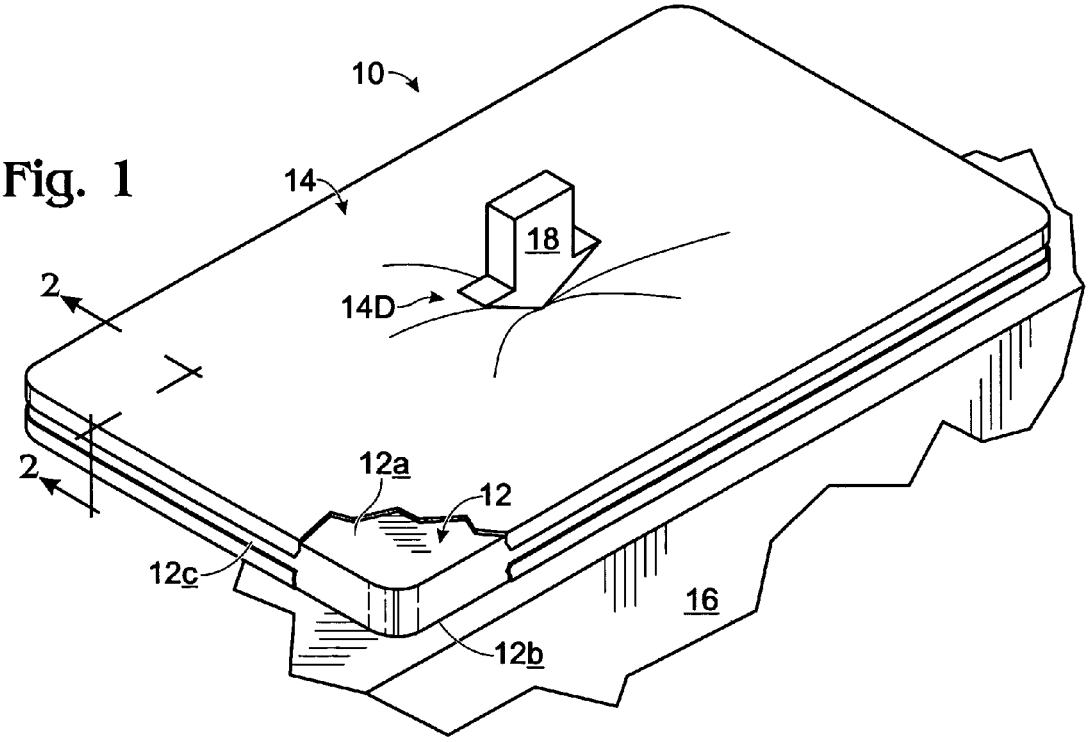
FIG. 1 is a simplified, isometric view of an anatomical pressure-evenizing mattress overlay constructed in accordance with a preferred and best-mode embodiment of the present invention resting upon a fragmentarily shown hospital-bed mattress, and with a portion of one corner of the illustrated overlay broken away to illustrate details of internal construction.
Figure 4:
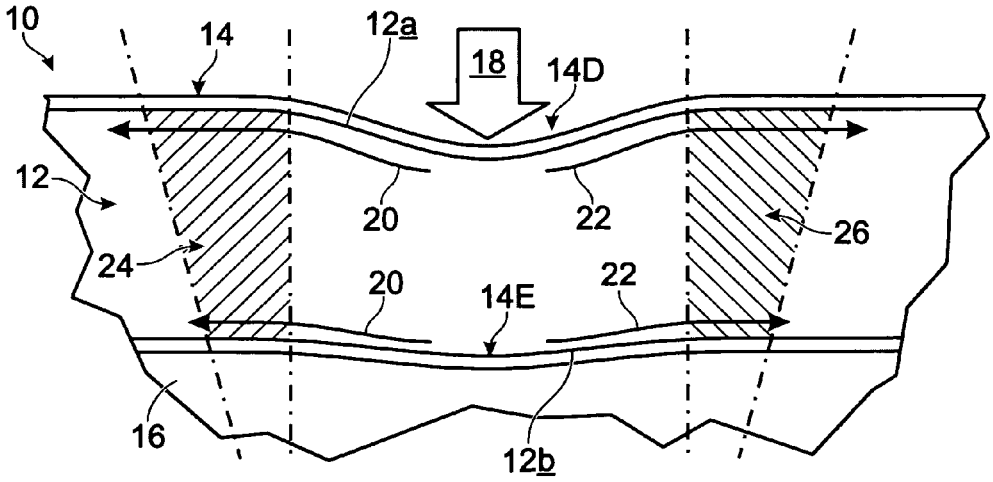

FIG. 4 is a simplified, fragmentary view, drawn on about the same scale which is employed in FIG. 2, illustrating anatomical, load-bearing response of the overlay of FIGS. 1-3, inclusive, and especially showing how the dynamic-response core of the overlay of the present invention responds to such loading. What is shown in FIG. 4 should be read along especially with what is seen in FIG. 1.

DETAILED DESCRIPTION OF THE INVENTION

Turning attention now to the drawings, and referring first of all to FIGS. 1-3, inclusive, indicated generally at 10 is a preferred and best-mode embodiment of an anatomical, pressure-evenizing mattress overlay constructed in accordance with the present invention. Overlay 10 herein has an overall thickness of about 1-inches (a preferred maximum thickness), a lateral width of about 36-inches, and a length of about 75-inches. Overlay 10 is formed, basically, from two different components, or portions, including a single-piece, dynamic-response core expanse 12, and a "differentiated character", elastomeric coating 14 whose differentiated features that relate to thickness and gas permeability (and consequently heat-removal handling) will shortly be described. Coating 14, as will shortly be explained, is load-transmissively (mechanically), interfacially (face-to-face) bonded to the entireties of the outside broad-planar-facial and edge-surface areas of expanse 12. The broad-planar-facial areas in core expanse 12 are shown at 12*a*, 12*b*, and the edge-surface area, which is full perimetral in nature, is shown at 12*c*.

In FIGS. 1 and 2, overlay 10 is shown resting upon a hospital-bed mattress of conventional construction shown generally, and fragmentarily-only, at 16 in these two drawing figures. As has been mentioned earlier herein, the mattress overlay of this invention need not necessarily be used in the setting of a conventional, hospital-bedding mattress, but may also be used, appropriately perimetrally shaped, to fit into other environments involving convalescing patients. In all instances, it is important that the mattress overlay of this invention be supported upon a mattress-like support structure, or other, similar, suitably yieldable understructure, in order to prevent core expanse 12 from bottoming out.

In this context, the about 1-inches thickness proposed herein as being preferable for the core expanse has been chosen for several reasons, one of which is that, when properly under-supported, and as above described, it will readily handle a person weighing about 350-lbs, and will also successfully deal, without bottoming out, with notably projecting, angular portions of the anatomy even involving persons of such weight. Under circumstances where an especially heavy person, for example someone who weighs more than about 350-pounds and up to about 500-lbs, is to be supported in accordance with practice of the invention, it is important that the overlay not be placed upon a hard and non-yielding undersurface, or be used alone as a mattress with stiff under-support. Such conditions could easily lead to bottoming out.

Rather the overlay should be placed on top of some auxiliary, underlying, bariatric, yieldable supporting structure.

In addition to the mattress overlay as a whole having a preferred thickness of about 1-inches in order to prevent a bottoming out situation, another important reason for choosing an overlay thickness limited to about 1-inches is that this is a thickness which works well to assure maximum availability of the significant air-breathability capabilities of the selected overlay components.

According to one very important feature of the present invention, core expanse 12 is formed of a 100% open-cell, single-density, viscoelastic foam most preferably made from the product known as #5010 CF Visco, polyurethane, Domfoam made by Domfoam International, Inc. in Montreal Quebec, Canada. This foam is both compressible and flowable. Significantly, this foam which has been chosen for the core expanse has another, very important, internal structural character whereby, under changing compression-pressure conditions, it exhibits a compressive-deflection vs. compression-force (or load) curve which includes an extremely linear region over which a relatively wide change in compressive deflection is accompanied by what turns out to be an anatomically insignificant (i.e., only slightly perceptible) change in compression pressure. This feature plays a very important role in assuring evenized support pressure applied statically and dynamically to the underside of a supported anatomy, notwithstanding the presences of, say, any bony anatomical protrusions.

For a reason which will now be explained, and as has already been mentioned above, core expanse 12, within the overall structure of overlay 10, is in a pre-stressed compressed condition, with a "relaxed-state" compression internally of about 8-10%. This compression is brought about by virtue of the presence of allover overcoating by coating 14 which is a multi-sublayered, sprayed-on, elastomeric, vinyl coating prepared with a "varied" overall thickness, as was mentioned earlier, and as will be more fully explained shortly, lying preferably in the range expressed earlier herein of about 0.01-inches to about 0.02-inches. Coating 14 preferably is made from a vinyl material such as that manufactured and sold by PlastiDip International in Blaine, Minn. under the identity Miraculon PDF-830. As was also mentioned earlier herein, coating 14 is prepared, illustratively and preferably, and in certain different regions of the coating, with different pluralities, and different, overall thicknesses, of sublayers, most of which (i.e., the "basic" sublayers), individually, have thicknesses of about 0.001-inches, and a few of which have the greater sublayer thickness which is employed herein of about 0.01-inches—these different sublayer pluralities and thicknesses accounting for the coating's "varied thickness" nature.

The coating is formed, almost throughout, in a special manner to ensure several important structural and performance features. One of these features is that, except in those coating regions included in the broad-area portions of the overlay, and in portions of the perimetral edge portions of the overlay, a special, inter-sublayer joinder exists between each of the sprayed-on sublayers to improve moisture-handling, gas-breathability, and attendant heat-removal capabilities of the coating. Another of these features is that the coating, when completed, demonstrates a controlled shrinkage which is responsible for placing core expanse 12 into compression, and the coating into a prestressed, tensed condition.

In the just-mentioned, broad-area and perimetral-edge thicker portions of the overlay, a different inter-sublayer joinder structure exists between the outermost sublayer, and the immediate next-inner sublayer. This will be more fully described shortly.

As was mentioned above, and as will now be more fully explained below, the coating-structure regions which cover facial areas 12*a*, 12*b* in the core expanse, as well as those which cover certain portions of perimetral edge area 12*c*, have outer sublayers that differ somewhat in construction from that of the outer sublayer regions of coating 14 which cover the vertically central, "horizontally elongate" portions of perimetral edge area 12*c* in the core expanse.

Directing attention specifically to FIGS. 2 and 3, here fragments of core expanse 12, and of different portions of the plural-sublayer construction of coating 14, are illustrated. Coating 14 includes (a) two, broad-area, about 0.02-inches-thick, facial portions 14A which extend over and cover facial areas 12*a*, 12*b* in core expanse 12, (b) two, elongate, vertically spaced, 0.02-inches-thick, perimetral edge bands 14B which extend over and cover spaced upper and lower parts of perimetral edge-area 12*c* in the core expanse, and (c) an elongate, vertically central, about 0.01-inches-thick, perimetral edge band 14C which extends over and covers that portion of the core expanse's perimetral edge-area 12*c* which lies between coating bands 14B. The vertical dimensions of coating bands 14B, 14C are substantially equal with dimensions each of about ⅓-inches—the term "vertical" herein relating generally to the orientations of FIGS. 2 and 3.

FIG. 3 illustrates, more particularly, the respective constructions of coating portions and bands 14A, 14B, 14C.

Each of these three coating portions/bands commonly includes (1) a primer sublayer 14*a* (shown in dashed lines) which has penetrated the adjacent outer portion of core expanse 12, and which adds no appreciable thickness to the coating, and (2) ten, joined, thin, "basic" sublayers, such as the two, basic sublayers shown at 14*b*. An interfacial bond (of the special, "wet-form" nature mentioned above), one of which is shown by a heavy line 14*c* in FIG. 3, exists between each of these just-mentioned primer and "basic" sublayers. This special interfacial bond is referred to herein as being defined by "initially wet", interfacial surfaces of joinder.

Coating portions 14A and bands 14B, alone among the regions in coating 14, include the previously-mentioned, additional, eleventh, thicker outer sublayer, such being pictured at 14*d* in FIG. 3. Sublayers 14*d* in these coating portions and linked bands form, in coating 14, a kind of cap, or capping structure, which "receives", to about one-third each the overall core-expanse thickness, the opposite facial zones in the core-expanse structure. Such capping structure(s), and particularly the edge bands therein, define laterally vertically-central breathing and moisture-venting bands in the overall overlay structure.

Coating band 14C includes only the combination of primer sublayer 14*a* and each of the ten, basic, thin sublayers 14*b*.

A consequence of this construction is that coating portions 14A and bands 14B preferably have overall thicknesses herein of about 0.02-inches, whereas coating band 14C has preferably an overall thickness of only about 0.01-inches.

As illustrated in FIG. 3, whereas all of the sublayers that are pictured there within the illustrated coating portions have been shaded to make them readable as individual sublayers, the shading which is specifically employed for outer, thick sublayer 14*d* is purposely of a different, somewhat more "dense", character than those shading characters that are employed in the other illustrated sublayers. This has been done herein in order to highlight the fact that this outer sublayer has been constructed (during spraying into place) so as to have the earlier, generally mentioned, somewhat different gas-permeability and heat-removal behaviors than similar behaviors of each of the next ten, other, underlying sublayers. More specifically, sublayer 14*d* has-been prepared so as to be, essentially, both moisture-impervious and gas-impermeable in nature, whereas the next ten, underlying, other sublayers, the so-called basic sublayers, have been prepared differently so as to be moisture-resistant (i.e., not impervious to moisture) and gas-permeable in nature.

Describing now the process preferably employed to create the different sublayers in the different regions, or portions, of coating 14, generally speaking, there are two, different spraying arrangements which are used during coating creation. One of these involves supporting a flat expanse of "material" (i.e., either an initial, not yet in any way coated, flat expanse of the mentioned core material alone, or, a flat expanse of partially coated core material) on a generally horizontal table, and producing linear, repetitive, plural-cycle relative motion between an overhead plurality of appropriately laterally and vertically spaced/distanced spray heads and the material-supported material expanse. This is preferably accomplished by holding the table and supported material stationary, and moving the spray heads. The other arrangement involves supporting a material expanse (by this time partially coated, as will be explained) in what might be a somewhat clamp-like jig, and producing relative rotational motion between the so-supported expanse and, typically, a single spray head, appropriately distanced so as to create the perimeter edge portions of the desired coating.

Preferably, spraying takes place, utilizing conventional Devilbiss spray-equipment spray guns (or spray heads) each with a #704 cap and a 0.055 spray tip and needle, in an environment which has a temperature of around 65° F., with a blend of air and the above mentioned Miraculon spray product supplied for spraying at the same temperature which is essentially. Environmental humidity preferably lies at about 25%. Throughout spraying, air and Miraculon are supplied to the spray-heads at respective flow pressures of 80-psi and 50-psi. As will be pointed out below, during different steps of spray-application, spray gun control valves are operated variously either fully open with respect to the supply of Miraculon, or "throttled down" to substantially ⅓-open conditions.

Further describing general spray-application conditions, it is preferable that the spray heads be disposed at a distance from the "target structure" by about 10- to about 12-inches, with the spray head organization which is employed during spraying broad-expanse areas of "target structure" being spaced by a distance whereby their respective sprays, where these strike the target, overlapping one another by about 50-percent. It is also preferable that relative (liner and rotational) motion, depending upon where spraying is taking place, at the rate of about 3-inches-per-second, be used between the spray-head structure and the structure being spray coated.

Coating preparation begins by placing a not yet edge-sized, i.e., not yet perimeter-sized, expanse of the above-mentioned Domfoam material on a horizontal table, and by then applying to the exposed broad surface area of the expanse, and first of all, a primer sublayer 14*a* of Miraculon material with the valves in the spray-heads fully open, and with "primer spraying" occurring in a single pass over the mentioned, exposed expanse area. This primer sublayer soaks into the Domfoam expanse to create a tenacious, mechanical bond directly with that expanse, leaving a wet surface exposed on the face of the expanse, but exhibiting no appreciable "external" depth (i.e., outwardly of the core expanse).

This primer sublayer spraying is immediately followed, while the primer sublayer material is still wet and uncured, with ten, successive next-adjacent-sublayer spray-head passes over the same, exposed expanse area, with the only difference being that the spray-head valves, in each pass, are throttled down to their above-mentioned ⅓-open conditions. Each of these next ten spray passes follows the immediately preceding pass while the last-applied sublayer is still wet and uncured to create the "wet-form", inter-sublayer bonds 14*c*. Each of these next, ten, "throttled-down", "wet-interface" passes produces a Miraculon sublayer 14*b* having a thickness of about 0.001-inches, and which is characterized with a quality of open "stringiness".

Following the procedure which has just been described relative to one broad surface of a Domfoam expanse, a spraying is paused for a period of about 30-minutes to allow the layers of material that have just been sprayed to dry and cure more thoroughly. Thereafter, the expanse is turned over and the process just described is repeated in its entirety to create a similar multi-sublayer coating on the opposite broad face of the expanse. This repeated procedure is followed by a similar pause in spraying as was just mentioned.

Thereafter, the Domfoam core expanse, which now has, on its opposite, broad faces, an almost completed coating (complete except for missing just the final, eleventh, thicker outer sublayer 14*d*), is allowed to "rest" for about 24-hours to enable all then-applied basic sublayers to cure substantially, and is then appropriately trimmed to have the correct perimetral outline.

The perimeter-trimmed expanse is next placed in a suitable supporting jig, which may take the form of a broad-platen clamping jig, for controlled relative rotation, first, in a single rotation cycle past a spray head (which is fully open) to apply an edge primer sublayer 14*a*, followed in quick succession by ten additional rotation cycles (with the spray head throttled down to a ⅓-open condition) to apply the intended, ten, edge-coating, wet-bonded sublayers 14*b*. Spraying is now paused for the same, above-mentioned, about 30-minute time interval, and for the same reason.

At this point in the coating process, the coated structure which has been created so far is broad-surface supported on a horizontal table, one side at a time, and sprayed on each broad surface with the spray heads in fully open conditions, and in a single spray pass per side, to create the required, about 0.01-inches thickness, final, eleventh, outer broad-area coating sublayers 14*d*. A spraying pause interval, here of about 24-hours, is interposed the spraying of these two broad surfaces.

What next occurs is that, effectively for each edge of the overlay structure formed so far, and with that partially completed overlay structure resting in a substantially horizontal plane, an elongate, about ¼-inch-diameter, metal (or plastic) rod (or the like) is suitably supported in a condition substantially horizontally disposed, parallel to and closely adjacent the edge, and vertically centered relative to the upper and lower broad faces of the structure, so as to furnish a "spray-shadow" mask which will be employed now for the purpose of assisting in the creation, along the relevant edge, of the two, separated, upper and lower coating bands 14B, and the associated, separating edge band 14C. This "rod-masking" may be performed (for spraying) either (a) on an edge-by-edge, single-edge basis, or (b), for all four edges "at once", utilizing a masking rod for each edge, or even a single, suitably sized and angled, single, "bent", circumsurrounding rod.

With rod-masking in-place, and with the overlay structure suitably supported, along with the masking rod structure, in a jig of the type generally mentioned earlier herein, a single spray pass (per edge) of the type generally employed to create just-described, thick coating sublayers 14*d* is implemented to create, around the perimetral edge of the structure what may be thought of as angularly intersecting, continuation portions of previously created, broad-surface-area layers 14*d*, in order to create the differential-thickness coating structure which is clearly illustrated in FIG. 3 in the drawings.

After this final edge spraying has taken place, the rod-masking structure is removed, and the entire, and all of the various spray sublayers in the now fully spray-coated core expanse are allowed to cure and dry even more thoroughly in an environment whose temperature is about 95° F., and for a period preferably of about 3-5-days.

When sublayer spraying takes place in accordance with these just mentioned and described, different spray-application (parameter) considerations, the various sublayers evidence the desired, differentiated gas-handling and moisture-permeability characteristics generally described for them above. A clear consequence of this coating-creation procedure is that different regions in the coating behave differently. In the two, broad-area portions 14A, and the two, vertically spaced, perimetral, edge portions (bands) 14B, of the coating, as far as the "outside world" is concerned, relative to the overlay's internal core expanse, there is a substantial moisture and gas-flow, impermeability barrier. Immediately inwardly in these two areas, however, i.e., immediately inwardly of the outer coating sublayer 14*d* in these areas, there is gas-breathability within the basic-sublayer, internal portions of the coating extending inwardly to adjacent the core expanse. In the vertically central, perimetral edge areas (bands) 14C of the coating, there is moisture resistance (but not impermeability), and gas-breathability, through and throughout this portion of the coating structure and in communication with the core expanse.

These important coating considerations result in several significant overlay conditions and behavioral features. In particular, the resulting structural joinder which develops in the interfacial regions between the individual, basic sublayers in coating 14 offers improved gas-breathability in the relevant regions mentioned above in the final structure of coating 14, and further, promotes appropriately controlled shrinkage of coating 14 as a whole to create the different pre-stressed compression and tension conditions mentioned above for the core expanse and the coating, respectively.

Thin application of at least the first-to-be-sprayed-on (i.e., core-expanse-contacting) primer sublayer regions in coating 14 causes the coating as a whole to bond robustly mechanically (in a manner which we refer to as load-transmissively) to the entire outside surface area of the core expanse, with the result that the localized regions of joinder of the core expanse and the coating function essentially as a unit everywhere within the overlay.

Adding reference now to FIG. 4 along with the other drawing figures, this bonding condition produces an "in-use" action, extremely important in the behavior of overlay 10, wherein expansive stretching of the coating, such as that which occurs, for example, when the anatomy, and particularly a sharp, anatomical protuberance therein, depresses the overlay support surface (see representative arrow 18 in FIGS. 1 and 4), pulls on the bonded core expanse, and causes (a) core-openness size in that pulled-on and resultingly expanded, core-expanse region to enlarge, and (b) airflow openness in at least the innermost sublayers in the coating to increase locally, thus immediately promoting increased airflow capability and activity in that region. Prestress compression in the core expanse importantly aids in this action, since that compression urges the core expanse to swell non-resistively, and expand. When the protuberance represented by arrow 18 engages the overlay, and with an understanding that things are purposely illustrated exaggeratedly in FIG. 4, it produces a significant depression 14D in coating 14, and a matching depression in the upper surface of core expanse 12. Given the modest thickness of the core expanse, this depression "telegraphs" its presence to some extent to the immediate underside of the expanse to produce the gentle downward bulging in coating 14 shown at 14E.

This "depression/bulging" condition is characterized, of course, by an expanding and stretching of the coating at the 14D, 14E locations therein, and attendant increasing of the there-local airflow permeability of at least the internal sublayers in the coating. This expanding and stretching, in addition to producing an interesting and effective, internal, "bellows" air-flow condition, causes related, outward, lateral "dragging" of the bonded core expanse, aided in that "dragging" by the relaxation of compression in that expanse. The squeezing which results in the core expanse between locations 14D, 14E produces slight, lateral, outward flowing of the expanse as indicated by arrows 20, 22, with outwardly flowed core expanse-material represented in the two, angular, lightly shaded region of that expanse shown at 24, 26.

Further considering air-flow (gas-flow) management features of overlay 10, particularly with reference to how the broad-area and vertically central, perimetral-edge regions of the core structure perform, the fact that the thicker, outer sublayers 14*d* in the coating are, effectively, gas-impermeable, depressions and relaxations of depressions which occur in the overlay, for example as a person supported on the overlay moves from time to time, recurrently create the just-above-mentioned kind of bellows air-flow effect within the inside of the overlay, forcing air to flow inwardly and outwardly through the gas-permeable (breathable) band portion (s) 14C in the coating.

It is these, several air-management features of the invention, promoted by relative thinness in the overall overlay, by the mechanical bondedness which exists between the core expanse and the coating, by the coating structure, and by the pre-compression/pretension conditions extant in the core expanse and coating, respectively, which cause the overlay to adapt needed anatomical-support airflow, and associated heat removal, in a manner whereby those supported areas of the anatomy which should receive enhanced, cooling airflow in the context of being protected against "decubitus onset" do receive such enhanced treatment. This adaptation behavior is dynamic, in the sense that changes in supported anatomy position are followed appropriately and instantly in the context of most-needed airflow availability.

We have also discovered that the thicker, outer coating sublayers in the overlay, on one of which a supported user will always be lying, aid in heat removal—transferring excess heat to the interior of the overlay, wherein air flow functions to discharge it laterally outwardly through the edges of the overlay. These same outer, thicker sublayers play an important role in minimizing friction and shear engagements with the anatomy of a supported person.

Prior art structures that are known to us have no such capabilities for offering this important decubitus-injury-minimizing behavior. In many instances, unfortunately, prior art structures often respond to support indentation in a harmful manner which closes off support-offering airflow capability the deeper/larger the indentation which exists.

Regarding moisture management, the moisture-impervious character of the thicker, outer broad-area and lateral-edge sublayers in the coating tend to inhibit external moisture entry into the core expanse, including, importantly, along the lateral margins of the overlay.

Where it is desired that the overlay of the present invention be employed with a person whose weight lies in the range, for example, of about 350-lbs to about 500-lbs, a suitable bariatric under-support structure should be employed. Preferably, this structure will have essentially the same perimetral outline as that of the supported overlay, and will furnish appropriate yieldable under-support to prevent bottoming out of the core expanse in the supported overlay. While many different kinds of such bariatric under-support structures may be employed, we have experimented successfully with a 1-inches thick pad formed of two layers of different, rate-sensitive, viscoelastic foam materials specifically made by AEARO Specialty Composites in Indianapolis Ind., with an upper layer in this pad having a thickness of about 0.75-inches and being formed of the material sold as Confor CF-42 foam, joined by adhesive bonding to a lower layer of the material sold as Confor CF-45 foam having a thickness of about 0.25-inches. There are, of course, many other materials which may be employed successfully for such a bariatric under-support structure.

Thus the present invention offers an anatomical pressure-evenizing mattress overlay including (1) a dynamic-response core expanse having spaced, upper and lower, surfaces and a perimetral edge extending between these surfaces, formed of a 100% open-cell, compressible and flowable, viscoelastic foam, and having a relaxed-state volume in the overlay which is prestressed, and about 8-10% compressed, thus to create a pre-compression condition in the expanse, and (2) an elastomeric, moisture- and gas-flow-managing coating, load-transmissively bonded to the entirety of the outside of the core expanse to function as a dynamically-responsive unit with the expanse, and possessing a relaxed-state internal prestressed tension condition.

Within this structure, the core expanse exhibits a compressive-deflection vs. compression-force curve which includes an extremely linear region over which a relatively wide change in compressive deflection is accompanied by an anatomically insignificant change in compression pressure.

The methodology of the invention features a method for furnishing pressure-evenized, dynamic-reaction support for the anatomy, including the steps of (a) supporting the anatomy with a 100% open cell viscoelastic foam, and (b) following such supporting, and within the supporting foam, reacting therein to both static and dynamic, anatomical-unevenness-produced indentations in the foam to expand and contract cell-openness size, whereby deeper and sharper indentations result in greater cell-openness size. With regard to this methodology, the reacting step includes laterally stretching and laterally flowing regions of the foam adjacent such indentations.

Thus, a unique mattress overlay structure, and a related methodology, aimed with a very particular focus on helping to resolve the decubitus ulcer/injury problem have thus been illustrated and described herein, with certain variations and modifications suggested. Among the important factors relating to resolving this very dangerous and widespread kind of injury, namely, (a) paying close attention to furnishing support for the anatomy with an overall, evenized pressure which falls within a certain, identified range of pressures, (b) controlling and minimizing friction and shear conditions in the interface between the overlay support structure and the anatomy, and (c), extremely importantly, furnishing adequate cooling airflow to the supported anatomy, all are dramatically dealt with by the present invention.

As has been pointed out with great particularity, the unique structure of the present mattress overlay includes a special core foam material which is completely 100% open-celled in nature, and which is nominally under compression, coated by a differential-thickness, moisture- and gas-managing elastomeric layer which is bonded tenaciously (interfacially, mechanically bonded) to the entire surface of core foam. This unique collaborative union of structures results in the occurrence of a very special performance regarding anatomically-cooling airflow, wherein the deeper the indentation produced in the overlay by a portion of the body supported on it, the greater the "effective openness" of the supporting core foam material to enhance airflow in the region, or regions, of such indentation, or indentations.

Accordingly, while a preferred and best mode embodiment of, and manner of practicing, the present invention have been illustrated and described herein, and certain variations and modifications suggested, we appreciate that other variations and modifications may be made without departing from the spirit of the invention, and it is our intention that all of the claims to invention will be construed as covering all such other variations and modifications.

We claim:

1. An anatomical pressure-evenizing mattress overlay comprising a dynamic-response core expanse having spaced, upper and lower, surfaces and a perimetral edge extending between said surfaces, formed of a 100% open-cell, compressible and flowable, viscoelastic foam, and having a relaxed-state volume in the overlay which is prestressed, and about 8-10% compressed, thus to create a pre-compression condition in the expanse, and an elastomeric, moisture- and gas-flow-managing coating, load-transmissively bonded to the entirety of the outside of said expanse to function as a dynamically-responsive unit with the expanse, and possessing a relaxed-state, internal, prestressed, tension condition; and wherein:

said expanse has opposite broad faces linked by a perimetral edge; and said coating, where it covers said broad faces, is formed so as to be substantially both moisture-impervious and gas-impermeable, but defines, where it covers a portion of said edge, a moisture-resistant but moisture-pervious and gas-permeable elongate perimetral edge band that defines a gas-breathable path extending between the expanse and the exterior of the overlay.

2. The overlay of claim 1, wherein said core expanse exhibits a compressive-deflection vs. compression-force curve which includes an extremely linear region over which a relatively wide change in compressive deflection is accompanied by what turns out to be an anatomically insignificant change in compression pressure.

3. The overlay of claim 1, wherein said core expanse is specifically form of a polyurethane material.

4. The overlay of claim 1, wherein said upper and lower surfaces are, allover, substantially equidistant.

5. The overlay of claim 1, wherein said expanse has a thickness throughout of about 1-inches.

6. The overlay of claim 1, wherein said coating defines:

one or more moisture-resistant and gas-permeable basic sublayers enclosing substantially the entirety of the core expanse, the basic sublayers defining an innermost basic sublayer proximate the expanse and an outermost basic sublayer proximate the exterior of the overlay; and a moisture-impervious and gas-impermeable outer sublayer interfacially bonded to the outermost basic sublayer at locations vertically adjacent each broad face, the outer sublayer abutting the elongate perimetral edge band.

7. The overlay of claim 6, wherein each of the basic sublayers is approximately 0.001 inches thick and each sublayer is joined to the next-adjacent sublayer joined though an initially wet, interfacial surface of joinder, wherein the outer layer includes the same material as the basic sublayers and defines a thickness selected to provide substantially moisture-impervious and gas-impervious characteristics.

8. The overlay of claim 6, wherein the coating includes a moisture-resisting and gas-permeable primer sublayer interfacially bonded to the innermost basic sublayer and that adds no appreciable thickness to the coating.

9. The overlay of claim 8, wherein the primer sublayer defines an initially wet elastomeric material that has penetrated an outer portion of the core expanse.

10. The overlay of claim 6, wherein the coating includes a plurality of interfacially joined basic sublayers defining a plurality of structural joinders that promote the relaxed-state, internal, prestressed, tension condition.

11. The overlay of claim 6, wherein the outer sublayer is thicker than the combined thickness of each of the basic sublayers.

12. The overlay of claim 6, wherein the outer sublayer covers:

the entire surface area of each broad face;

an upper part of the perimetral edge;

a lower part of the perimetral edge spaced from the upper part of the perimetral edge; and wherein the coating is gas-breathable between the upper part of the perimetral edge and the lower part of the perimetral edge around the overlay's entire perimeter.

13. The overlay of claim 1, wherein said coating possesses broad-area portions covering said upper and lower core-expanse surfaces characterized by moisture-imperviousness and gas-impermeability, and edge regions covering portions of said core expanse's perimetral edge characterized by moisture-resistance and gas-permeability.

14. The overlay of claim 1, wherein the perimetral edge defines a corner and the elongate perimetral edge band extends around the entirety of the corner.

15. The overlay of claim 1, wherein the elongate perimetral edge band extends around the entire perimeter of the overlay.

16. The overlay of claim 1, wherein the coating defines a pair of at least externally moisture-impervious and gas-impermeable capping structures that each receive opposite broad faces and about one-third of the overall core-expanse thickness to define a laterally vertically-central breathing and moisture-venting band in the overall overlay structure.

17. The overlay of claim 16, wherein each capping structure includes:

one or more moisture-resistant and gas-permeable basic sublayers interfacially joined with the core expanse, including an outermost basic sublayer distal the core expanse; and a moisture-impervious and gas-impervious outer sublayer interfacially joined with the outermost basic sublayer; and wherein each capping structure defines a thickness of about 0.02 inches.

18. An anatomical pressure-evenizing mattress overlay comprising a core expanse of single-density, 100%, open-cell, compressible and flowable, polyurethane, viscoelastic foam, and an at least partially gas-breathable, elastomeric coating extending over the entirety of the surface area of said core expanse, and interfacially, mechanically bonded to said surface area, said coating being everywhere in tension and placing said core expanse everywhere in compression, wherein the coating defines a gas-impermeable and moisture-impermeable outer sublayer including an upper outer sublayer portion covering an upper portion of the expanse and a lower outer sublayer portion covering a lower portion of the expanse, the coating further defining a gas-breathable and moisture-resistant elongate perimetral band extending between the upper outer sublayer portion and the lower outer sublayer portion.

19. A method for furnishing pressure-evenized, dynamic-reaction support for the anatomy comprising supporting the anatomy with a 100% open cell viscoelastic foam, and following said supporting, and within the supporting foam, reacting therein to both static and dynamic, anatomical-unevenness-produced indentations in the foam to expand and contract cell-openness size, whereby deeper and sharper indentations result in greater cell-openness size;

wherein:

said reacting includes laterally stretching and laterally flowing regions of the foam adjacent such an indentation, thereby increasing local-airflow permeability of the regions of the foam adjacent the indentation; and the foam directs, in response to the indentation, a gas to positions within the foam distal the indentation through the foam.

20. The method of claim 19, wherein the foam is covered by a coating defining a gas-impermeable and moisture-impermeable outer sublayer defining a gas-breathable and moisture-resistant opening extending between the upper outer sublayer portion and the lower outer sublayer portion; and reacting includes directing gas from the foam through the gas-breathable opening in response to the anatomical-uneveneness-produced indentation.

* * * * *